US012709973B1

(12) United States Patent
Roh et al.

(10) Patent No.: US 12,709,973 B1
(45) Date of Patent: Aug. 18, 2026

(54) DRILLING PARAMETER DERIVATION WORKFLOW FOR AUTONOMOUS DIRECTIONAL DRILLING

(71) Applicant: Schlumberger Technology Corporation, Sugar Land, TX (US)

(72) Inventors: Si Jine Roh, Houston, TX (US); Samba Ba, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/296,093

(22) Filed: Aug. 11, 2025

(51) Int. Cl.
*E21B 44/00* (2006.01)
*E21B 7/06* (2006.01)

(52) U.S. Cl.
CPC ..... *E21B 44/00* (2013.01); *E21B 7/068* (2013.01); *E21B 2200/20* (2020.05); *E21B 2200/22* (2020.05)

(58) Field of Classification Search
CPC ..... E21B 44/00; E21B 7/068; E21B 2200/20; E21B 2200/22
See application file for complete search history.

(56) References Cited

U.S. PATENT DOCUMENTS 5,202,680 A * 4/1993 Savage ..... E21B 47/017 342/44
2010/0185395 A1* 7/2010 Pirovolou ..... E21B 7/04 702/9
2017/0306702 A1* 10/2017 Summers ..... E21B 7/10
2023/0203931 A1* 6/2023 Pho ..... G06N 5/022 175/24
2024/0202407 A1* 6/2024 Boualleg ..... G06F 30/27

* cited by examiner

*Primary Examiner* — Yanick A Akaragwe
(74) *Attorney, Agent, or Firm* — Kyle R. Miiller

(57) ABSTRACT

A method for performing autonomous directional drilling includes receiving input data. The input data includes a planned trajectory of a wellbore including a target, a current position of a bottom of the wellbore, a plurality of drilling parameters, and a maximum dog leg severity (DLS) capability of a bottom hole assembly (BHA) drilling the wellbore. The method also includes determining an amount of DLS to reach the target from the current position of the bottom of the wellbore based upon the input data. The method also includes determining a modification to one or more of the drilling parameters based upon the amount of DLS to reach the target and the maximum DLS capability.

18 Claims, 11 Drawing Sheets

DRILLING PARAMETER DERIVATION WORKFLOW FOR AUTONOMOUS DIRECTIONAL DRILLING

BACKGROUND

Directional drilling refers to the intentional deviation of a wellbore from the path it would naturally take. This is accomplished through the use of whipstocks, bottomhole assembly (BHA) configurations, instruments to measure the path of the wellbore in three-dimensional space, data links to communicate measurements taken downhole to the surface, mud motors and special BHA components and drill bits, including rotary steerable systems and drill bits. The directional driller also exploits drilling parameters such as weight on bit and rotary speed to deflect the bit away from the axis of the existing wellbore.

While many techniques can accomplish this, the general concept is simple: point the bit in the direction that one wants to drill. The most common way is through the use of a bend near the bit in a downhole steerable mud motor. The bend points the bit in a direction different from the axis of the wellbore when the entire drillstring is not rotating. By pumping mud through the mud motor, the bit turns while the drillstring does not rotate, allowing the bit to drill in the direction it points. When a particular wellbore direction is achieved, that direction may be maintained by rotating the entire drillstring (including the bent section) so that the bit does not drill in a single direction off the wellbore axis, but instead sweeps around and its net direction coincides with the existing wellbore.

What is needed, however, is an improved system and method for autonomous directional drilling.

SUMMARY

A method for performing autonomous directional drilling is disclosed. The method includes receiving input data. The input data includes a planned trajectory of a wellbore including a target, a current position of a bottom of the wellbore, a plurality of drilling parameters, and a maximum dog leg severity (DLS) capability of a bottom hole assembly (BHA) drilling the wellbore. The method also includes determining an amount of DLS to reach the target from the current position of the bottom of the wellbore based upon the input data. The method also includes determining a modification to one or more of the drilling parameters based upon the amount of DLS to reach the target and the maximum DLS capability.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

System Overview

Figure 1:
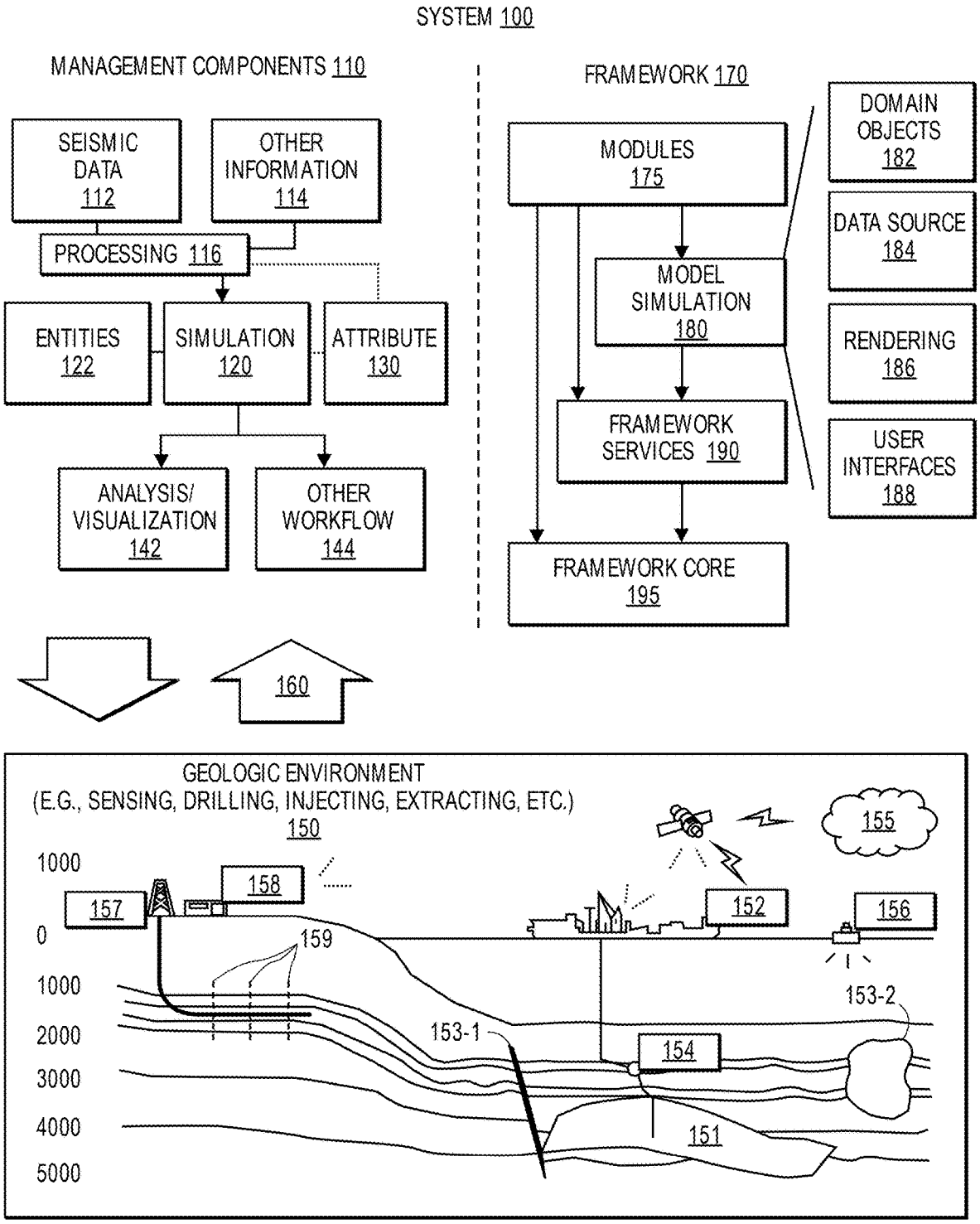
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116 (e.g., including calibration of the processing results with well data), a simulation component 120, an attribute component 130, an analysis/visualization component 142 and a workflow component 144. In operation, seismic data and other information provided per the components 112 and 114 may be input to the simulation component 120. The other information may be or include well data. The components, 112, 114 may be or include well data such as well logs, drilling logs, and/or cores, which may be used to calibrate the seismic data to rock and fluid properties.

In an example embodiment, the simulation component 120 may rely on entities 122. Entities 122 may include earth entities or geological objects such as wells, well data (e.g., used for calibration of rock and fluid properties), surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT®.NET® framework (Redmond, Washington), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (SLB, Houston Texas), the INTERSECT™ reservoir simulator (SLB, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (SLB, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (SLB, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a workstep may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Drilling Parameter Derivation Workflow for Autonomous Directional Drilling

Currently, when performing directional drilling jobs, trajectory update requirements are separated from drilling parameters derivation. The method described herein links the trajectory update requirements and drilling parameters derivation to have a joint optimization for both of them at the same time. This may be achieved by using trajectory requirements to derive and optimize drilling parameters.

Simplified Model of DLS Saturation-ROP Recommendation

The method described herein includes a simplified model of the relationship between dog leg severity (DLS) saturation and rate of penetration (ROP) recommendation. The model causes target ROP to be changed when the steering ratio (SR) is 100%, and the yield at the hole bottom is off by ±20% than target DLS. The model calculates the optimal ROP based on the target DLS, also known as dog leg needed (DLN), in current drilling conditions. The ROP set point may be adjusted based on the yield and target DLS to ensure optimal drilling performance.

$$ROP_{SetPoint} = ROP_{Current}\frac{\text{Yield}_{HBE}}{DLS_{target}} \tag{1}$$

$$\text{Yield}_{HBE} = DLS_{target}\frac{ROP_{SetPoint}}{ROP_{Current}} \tag{2}$$

$$\left|\frac{\text{Yield}_{HBE} - DLS_{target}}{DLS_{target}}\right| > 20\% \tag{3}$$

Equations (1-3) Deriving Yield at Estimated Hole Bottom and Detect DLS Saturation Status DLN Calculations DLN calculations may be performed to determine the DLS required to land the well accurately. This particular workflow supports landing context and includes calculations for DLN with solver validity checks.

DLN Solver Validation

Figure 2:
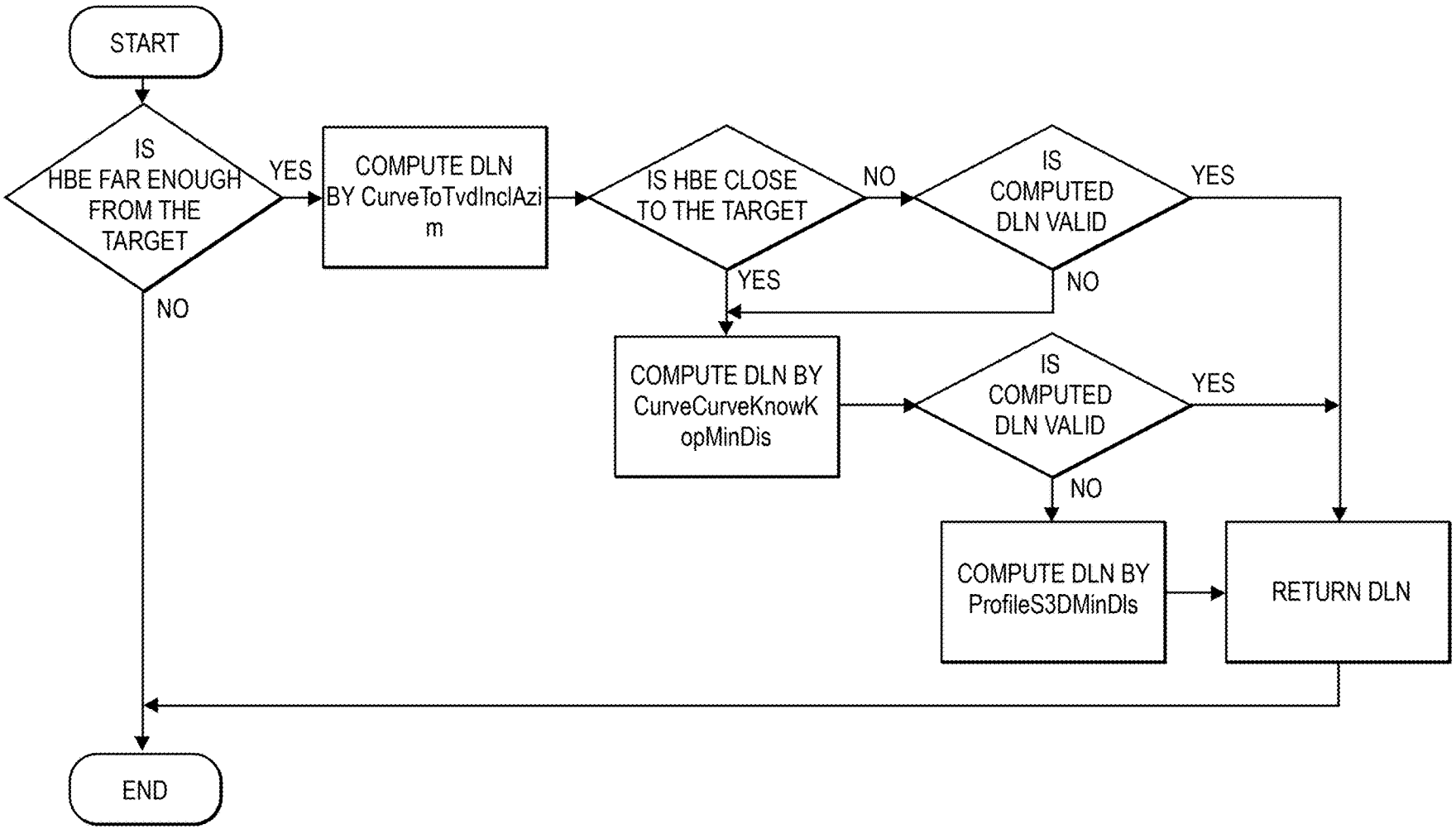
FIG. 2 illustrates a flowchart of a method for the dog leg needed (DLN) solver validation, according to an embodiment.

FIG. 2 illustrates a flowchart of a method for the DLN solver validation, according to an embodiment. The method includes DLN solver validation to ensure the accuracy and reliability of the DLN calculations. This particular workflow validates the solver's output and ensures that the recommended ROP adjustments are feasible and effective.

ROP Validation

Figure 3:
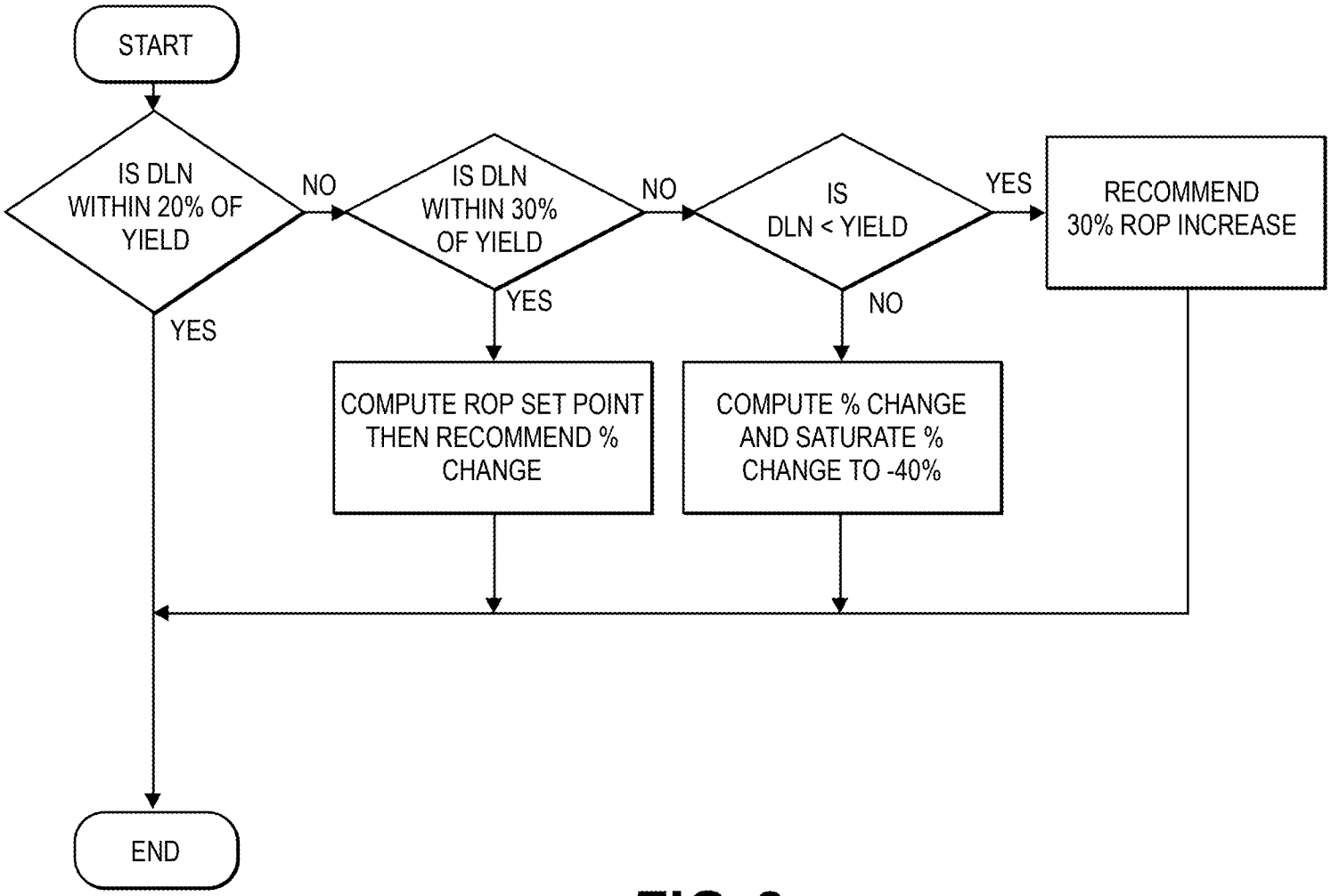
FIG. 3 illustrates a flowchart of a method for the rate of penetration (ROP) validation, according to an embodiment.

FIG. 3 illustrates a flowchart of a method for the ROP validation, according to an embodiment. The method includes ROP validation to monitor the current ROP and compare it with a ROP set point. If the ROP set point deviates by more than a predetermined amount from the current ROP, the system recommends adjustments to bring the ROP within the desired range. Recommended desired ranges for the method may be 120-130% for the upper limit, and 60-80% for the lower limit. The percentage change in ROP may be calculated as follows.

$$\%\ \text{change} = \frac{ROP_{SetPoint} - ROP_{Current}}{ROP_{Current}} \tag{4}$$

Exemplary Method

Figure 4A:
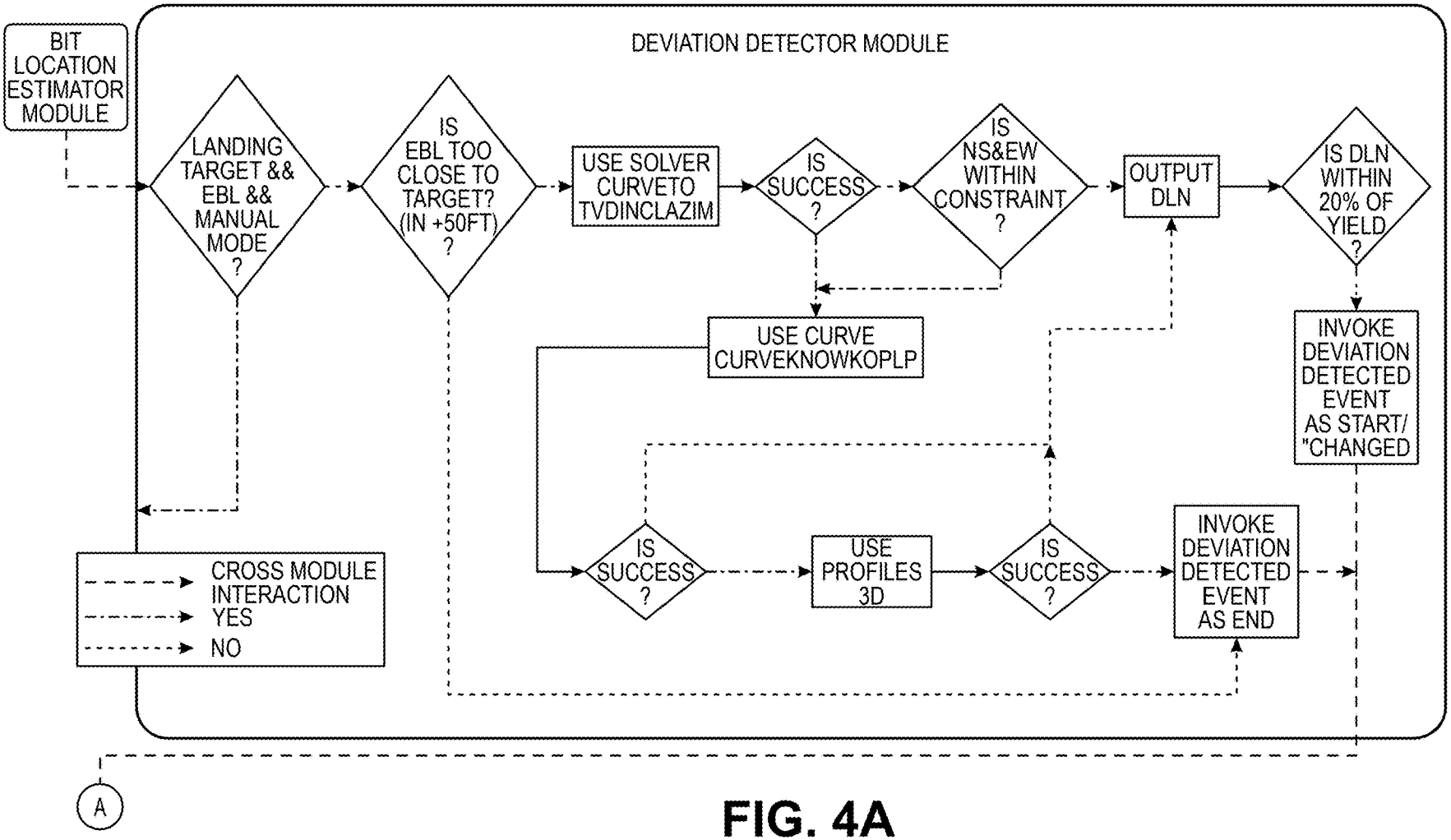
FIGS. 4A and 4B illustrate a flowchart of a method for autonomous directional drilling, according to an embodiment.
Figure 4B:
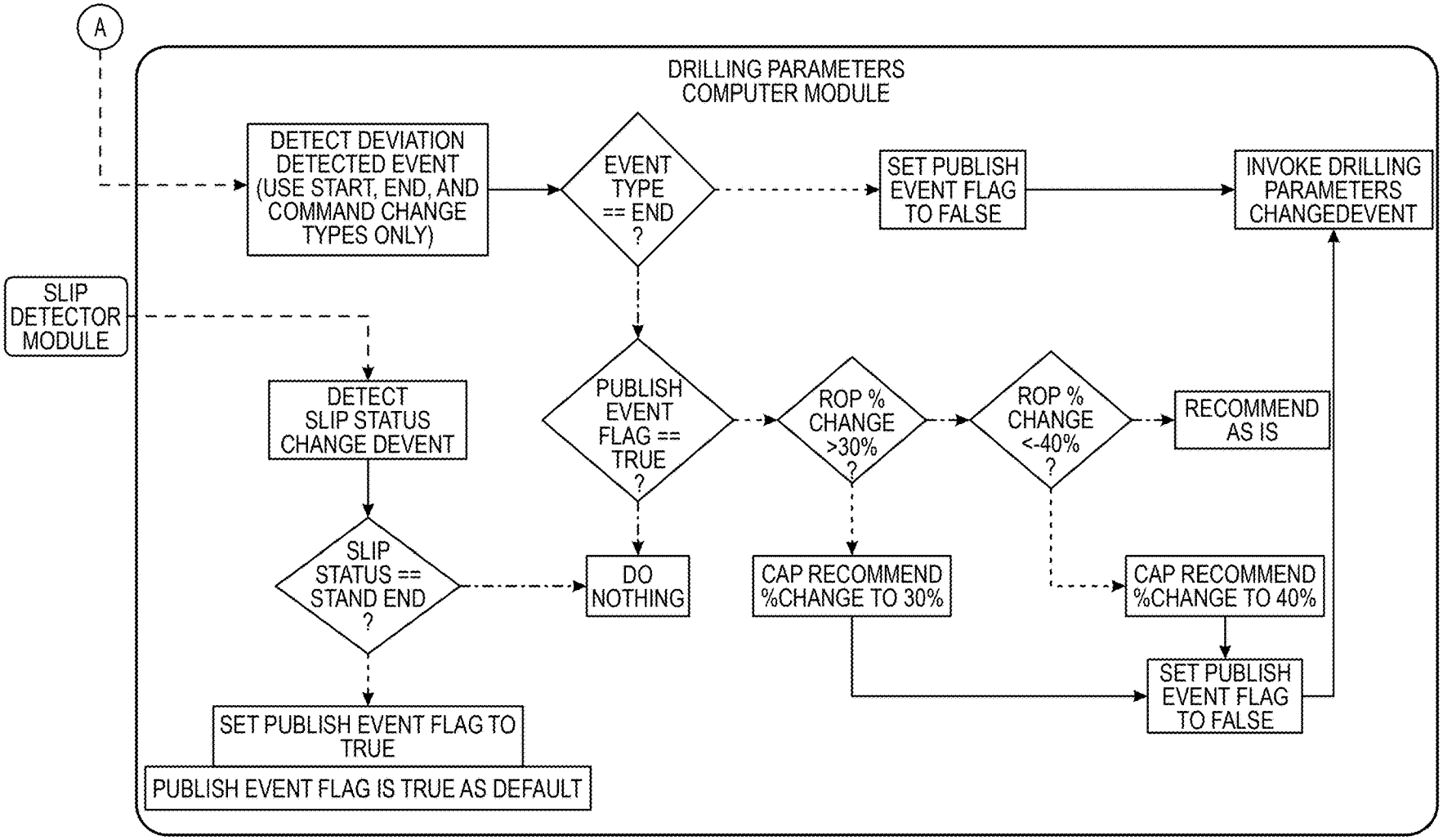

FIGS. 4A and 4B illustrate a flowchart of a method for autonomous directional drilling, according to an embodiment. More particularly, the method may recommend a ROP during autonomous directional drilling. An illustrative order of the method is provided below; however, one or more portions of the method may be performed in a different order, simultaneously, repeated, or omitted. At least a portion of the method may be performed with a computing system (described below).

The method may include identifying a target and EBL. More particularly, the method begins by identifying the landing target, the EBL, and the current drilling mode. If the target is a landing target, the EBL is not within a predetermined distance (e.g., 50 feet) of the target, and the NS and EW coordinates are within the target constraints, the method proceeds to the next step.

The method may also include determining the DLN. More particularly, the method may use a solver to determine the DLN based on the planned trajectory and the actual trajectory.

The method may also include comparing DLS and DLN. If the difference between the current DLS and the calculated DLN is within a predetermined range (e.g., 20%), the method takes no action. However, if the difference between the DLS and DLN is greater than 20%, the method recognizes the current situation as deviated.

The method may also include determining an optimal ROP. More particularly, the method calculates the optimal ROP and compares it with the actual ROP. The difference is returned as a percentage (e.g., to the user). The recommended ROP percentage change may be capped at upper and lower values (e.g., 30% and −40%) to ensure stability and prevent drastic changes.

The method may also include performing event handling. More particularly, the method invokes the deviation detected event as start or changed because of the parameters, if the DLN is not within 20% of the yield. The method detects the deviation detected event using Start, End, and command change types. The method sets the publish event flag to FALSE if the event type is End. Otherwise, the method sets the publish event flag as TRUE. The method detects the Slip status changed event and sets the publish event flag to TRUE if the slip status is Stand. If the EBL is too close, the method invokes the deviation detected event as END.

The method may also include receiving or generating a parameter-based recommendation UX/Widget design for user interaction.

Solver Validity Check

Figure 5:
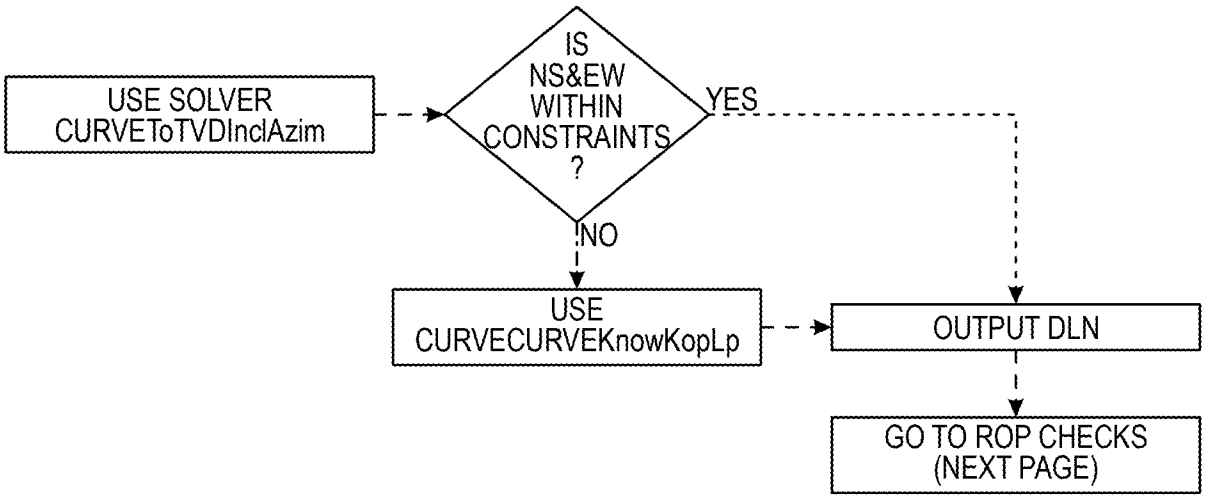
FIG. 5 illustrates a flowchart of a method for checking a validity of a solver, according to an embodiment.

FIG. 5 illustrates a flowchart of a method for checking a validity of a trajectory solver used to project to the target, according to an embodiment. The solver may be evaluated in terms of how close it is with respect to the 3D position of the target. If the solver cannot reach the 3D position of the target, a different solver may be used.

ROP Check

Figure 6:
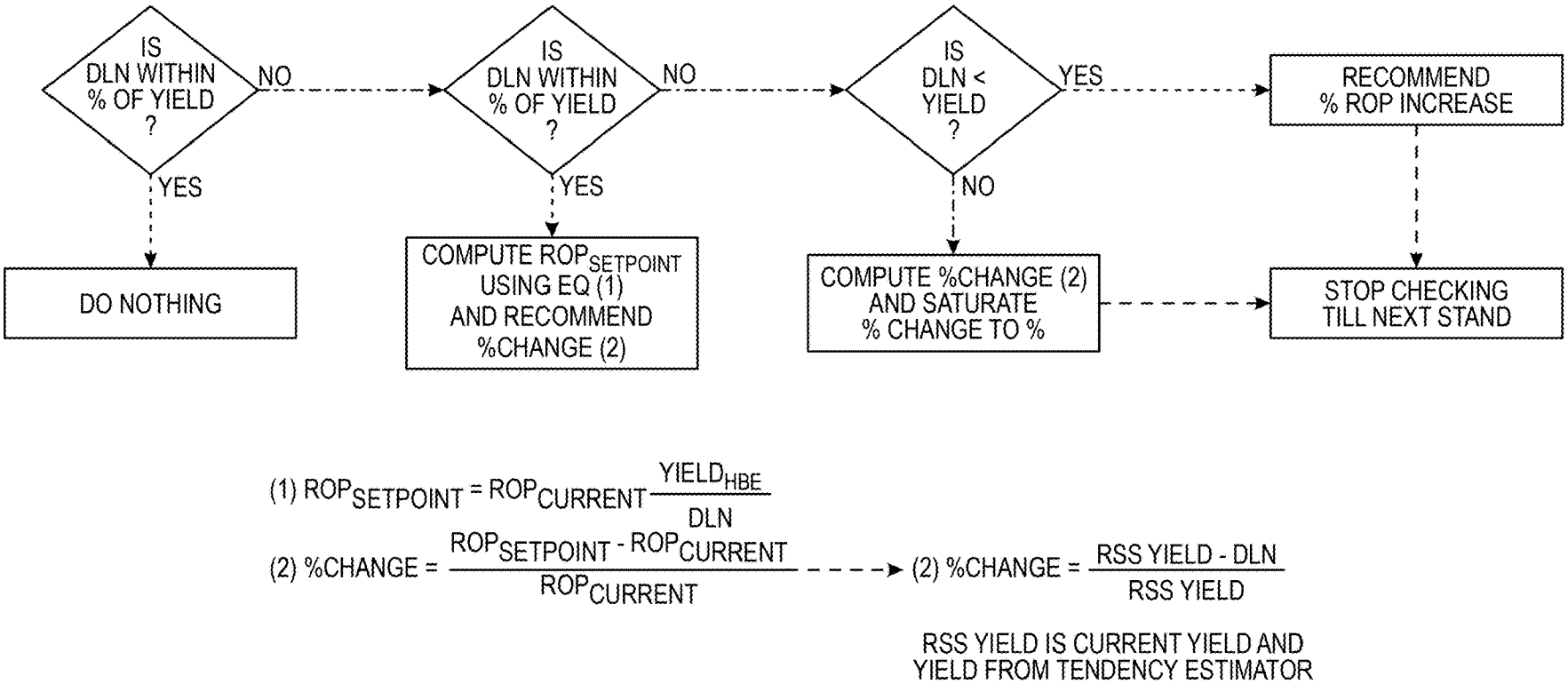
FIG. 6 illustrates a flowchart of a method for checking the ROP, according to an embodiment.
Figure 7A:
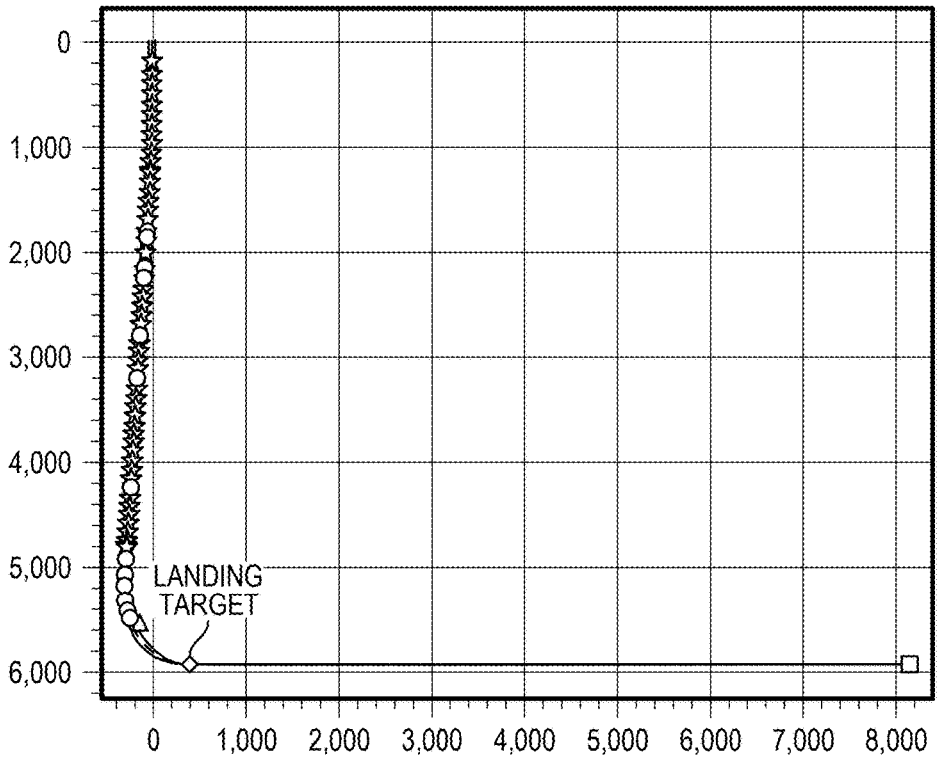
FIGS. 7A and 7B illustrate graphs showing a vertical view and a top view, respectively, of trajectory in real-time being executed with the landing target identified, according to an embodiment.
Figure 7B:
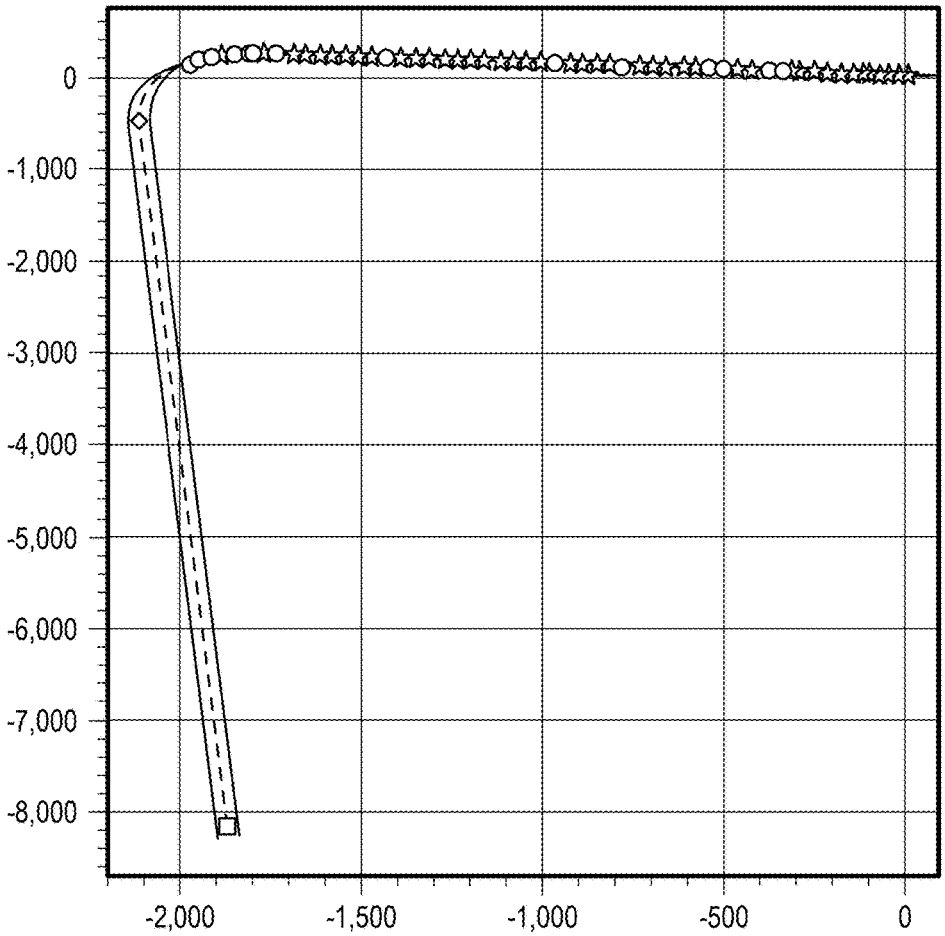

FIG. 6 illustrates a flowchart of a method for checking a ROP, according to an embodiment. The ROP may be recommended based upon the relative values of the DLN and the yield. FIGS. 7A and 7B illustrate graphs showing a vertical view and a top view, respectively of a trajectory in real-time being executed with the landing target identified, according to an embodiment. In FIG. 7A, the X axis is the total horizontal displacement whereas the Y axis is the true vertical depth (TVD). In FIG. 7B, the X axis is the North/South trajectory displacement whereas the Y axis is the East/West trajectory displacement.

DLS Dependencies

Figure 8:
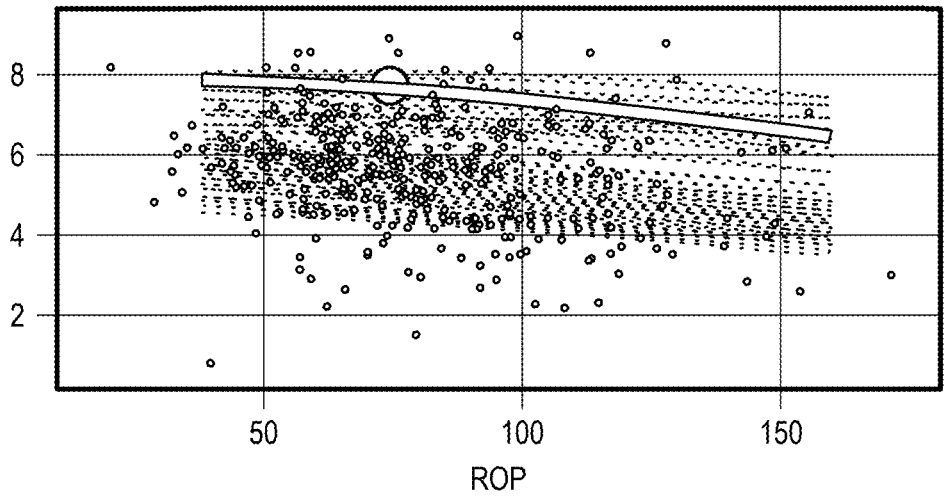
FIG. 8 illustrates a graph showing dog leg severity (DLS) dependencies on ROP and RPM, according to an embodiment.

FIG. 8 illustrates a graph showing DLS dependencies on ROP and RPM, according to an embodiment. The method consumes the data points of the ROP versus DLS and use a model such as ML, AI, and/or LLM to derive the relationship between ROP and DLS.

Percentage Change

Figure 9:
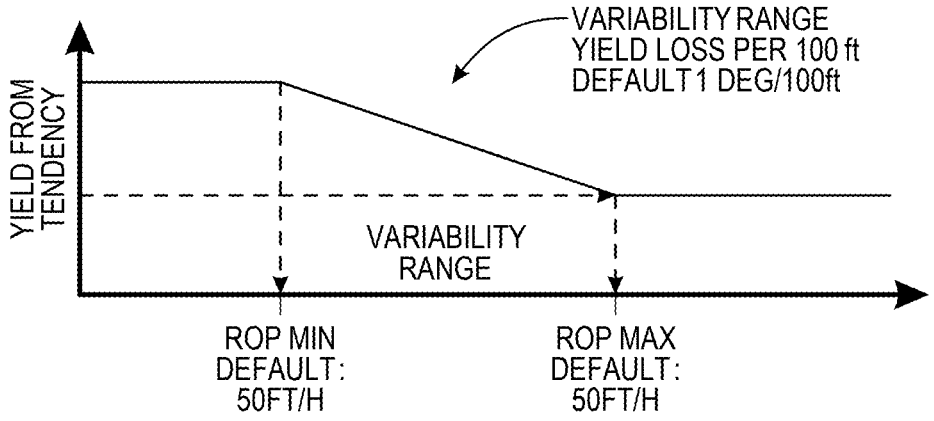
FIG. 9 illustrates a schematic view showing a yield from tendency versus ROP, according to an embodiment.

FIG. 9 illustrates a schematic view showing a yield from tendency versus ROP, according to an embodiment. More particularly, FIG. 9 shows an example of a model in three stages. The first stage may be a constant high yield, the second stage may be a decreasing yield versus ROP, and the third stage may be a constant low yield after the ROP reaches a certain value.

Exemplary Method

Figure 10:
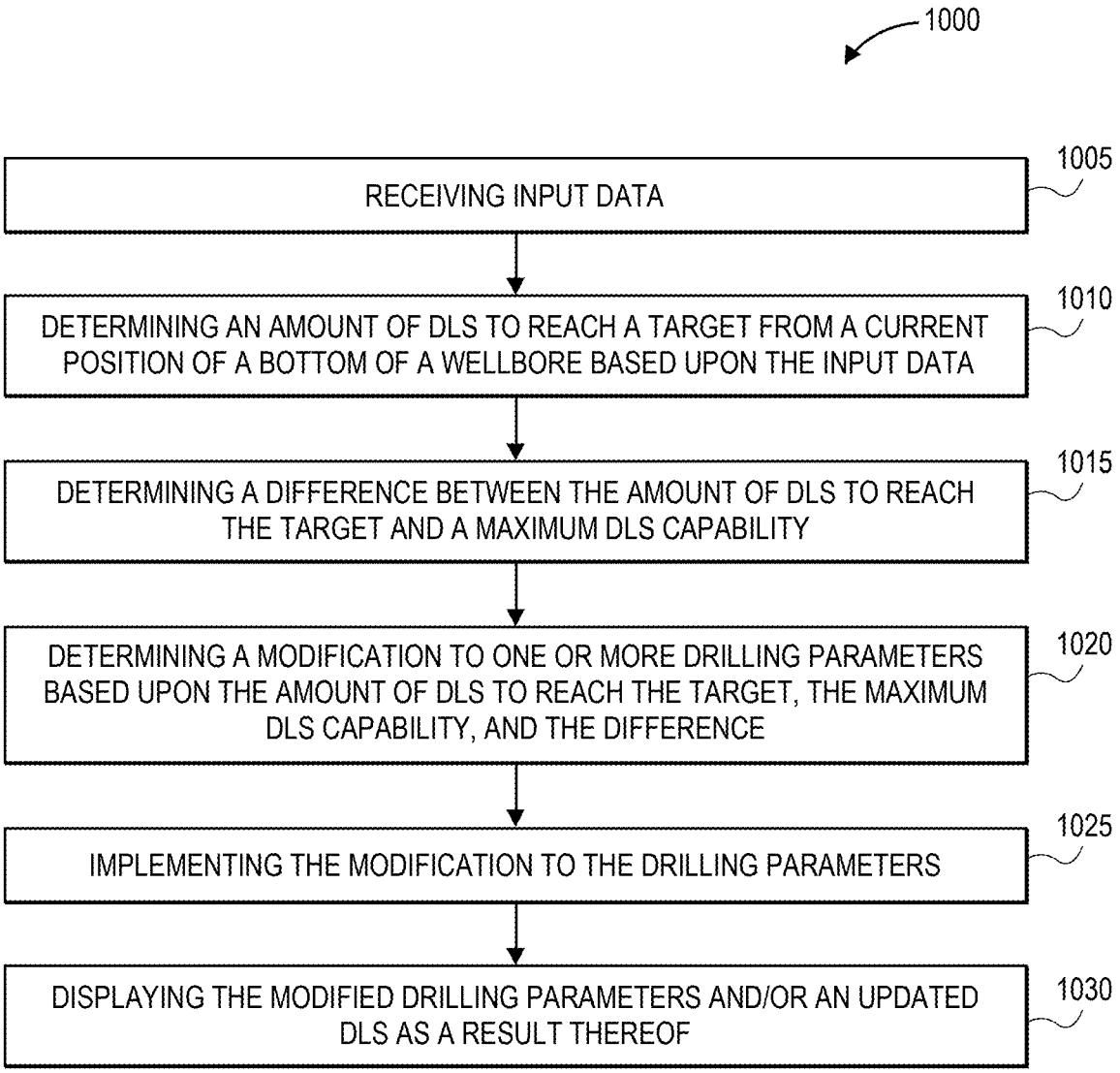
FIG. 10 illustrates a flowchart of a method for performing autonomous directional drilling, according to an embodiment.

FIG. 10 illustrates a flowchart of a method 1000 for performing autonomous directional drilling, according to an embodiment. An illustrative order of the method 1000 is provided below; however, one or more portions of the method 1000 may be performed in a different order, simultaneously, repeated, or omitted. At least a portion of the method 1000 may be performed with a computing system (described below).

The method 1000 may include receiving input data, as at 1005. The input data may include a planned trajectory of a wellbore. The planned trajectory may include a target for the wellbore to reach and/or a context of the planned trajectory. The context may include horizontal portions, vertical portions, deviated portions, curved portions, landing portions, or a combination thereof. The input data may also or instead include a current position of a bottom of the wellbore. The input data may also or instead include a plurality of drilling parameters. The drilling parameters may be or include a steering ratio of a bottom hole assembly (BHA) drilling the wellbore, a rate of penetration (ROP) of the BHA in the wellbore, an inclination of the wellbore, an azimuth of the wellbore, a tool face of the BHA, surface rotations per minute (SRPM), collar rotations per minute (CRPM), a flow rate through the BHA, surface weight-on-bit (WOB), a measured depth (MD) offset to run start, a true vertical depth (TVD) of the wellbore, a mud weight in the wellbore, or a combination thereof. The input data may also or instead include a maximum dog leg severity (DLS) capability of the BHA drilling the wellbore. The BHA may be or include a rotary steerable system (RSS). The input data may also or instead include a tool state of the RSS.

The method 1000 may also include determining an amount of DLS to reach the target from the current position of the bottom of the wellbore based upon the input data, as at 1010. The amount of DLS may be determined using a single curvature to reach the target based upon the TVD of the wellbore, a North South (NS) of the wellbore, and an East West (EW) location of the wellbore. The amount of DLS may also or instead be determined using a plurality of curvatures with varying DLS to reach the target. The amount of DLS may also or instead be determined using a curvature to reach the target defined by the TVD, the inclination of the target, and the azimuth of the target. The amount of DLS may also or instead be determined using a curvature to reach the target defined by a MD of the target, the inclination of the target, and the azimuth of the target. The amount of DLS may also or instead be determined using a modified Lubinski curvature to reach the target.

The method 1000 may also include determining a difference between the amount of DLS to reach the target and the maximum DLS capability, as at 1015.

The method 1000 may also include determining a modification to one or more of the drilling parameters based upon the amount of DLS to reach the target, the maximum DLS capability, the difference, or a combination thereof, as at 1020. The modification may also be based upon historical offset data of nearby wellbores having similar profiles by comparing maximum DLS capabilities of BHAs drilling the similar nearby wellbores with drilling parameters of the BHAs drilling the similar nearby wells. In a first example, the comparison may be defined by:

$$\text{Max } DLS = a - b * ROP \text{ for a } ROP \text{ range} \tag{5}$$

where Max DLS represents the maximum DLS capabilities of BHAs drilling the similar nearby wellbores, and a and b represent numerical coefficients. The comparison may also or instead be defined by:

$$\text{Max } DLS = x + y * Q + z * Q^2 \tag{6}$$

where x, y, and z represent numerical coefficients and Q represents flow rate. The comparison may also or instead be defined by:

$$\text{Max } DLS = x' + y' * RPM + z' * RPM^2 \tag{7}$$

The modification may be determined by a machine learning (ML) model, an artificial intelligence (AI) model, or a generative AI (GenAI) model based upon a dependency between the maximum DLS capability and the drilling parameters. The dependency may be based upon the historical offset data of the nearby wellbores or worldwide wellbores having the similar profiles and the BHAs drilling the similar nearby wells. The modification may be or include a percentage of change to make to a single one of the drilling parameters based on the difference. The modification may also or instead be or include a percentage of change to make to two or more of the drilling parameters simultaneously based on the difference.

The method 1000 may also include implementing the modification to the drilling parameters, as at 1025. Implementing the modification may include generating and/or transmitting a signal that recommends, instructs, or causes the implementation to occur. In another embodiment, the modification may be physically implemented by a user. The modification may modify the amount of DLS, which may modify the direction of the drilling (e.g., the trajectory of the BHA) toward the target.

The method 1000 may also include displaying the modified drilling parameters and/or the modified direction/trajectory resulting therefrom, as at 1030.

Exemplary Computing System

Figure 11:
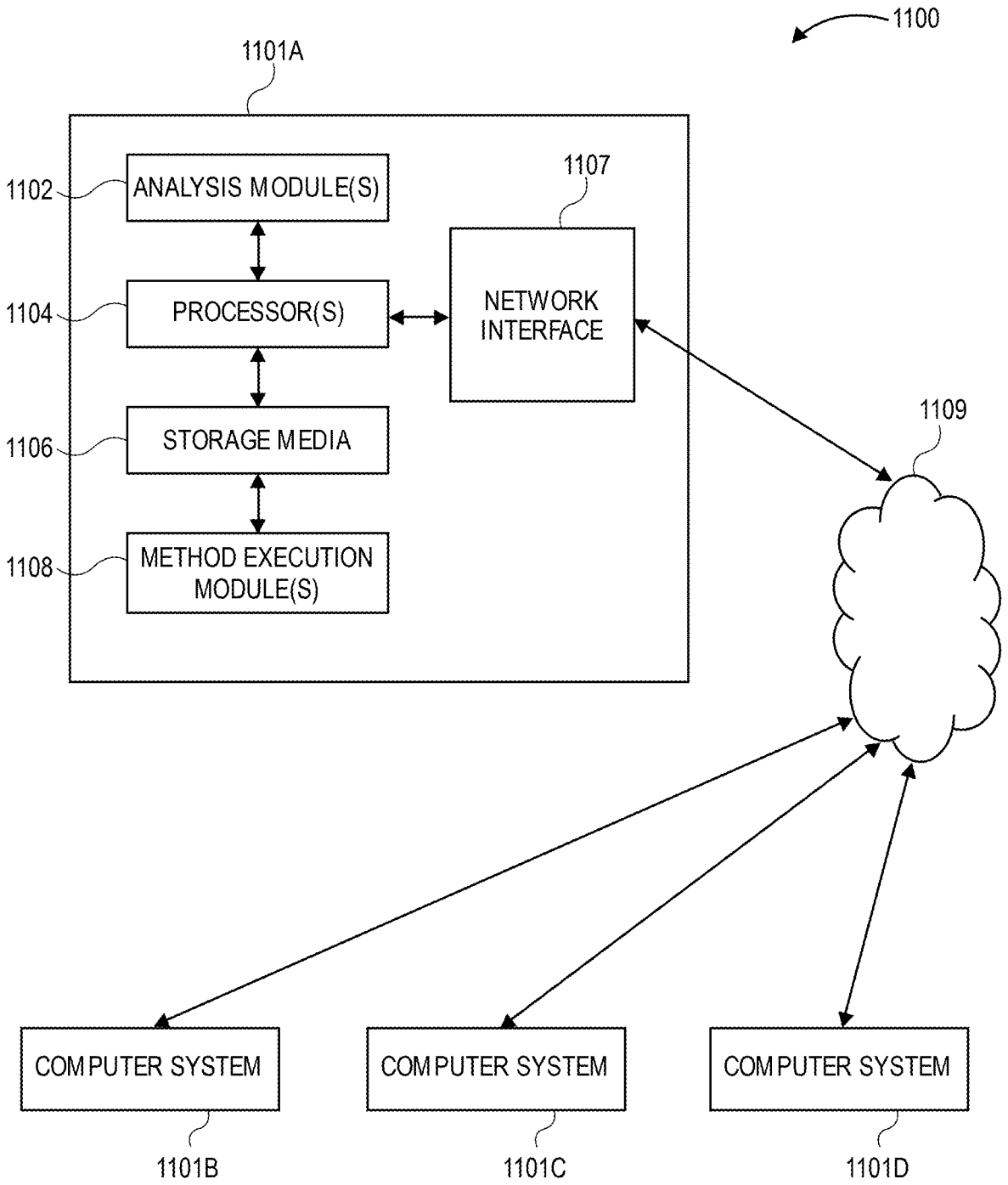
FIG. 11 illustrates a schematic view of a computing system for performing at least a portion of the method(s) described herein, according to an embodiment.

In some embodiments, the methods of the present disclosure may be executed by a computing system. FIG. 11 illustrates an example of such a computing system 1100, in accordance with some embodiments. The computing system 1100 may include a computer or computer system 1101A, which may be an individual computer system 1101A or an arrangement of distributed computer systems. The computer system 1101A includes one or more analysis modules 1102 that are configured to perform various tasks according to some embodiments, such as one or more methods disclosed herein. To perform these various tasks, the analysis module 1102 executes independently, or in coordination with, one or more processors 1104, which is (or are) connected to one or more storage media 1106. The processor(s) 1104 is (or are) also connected to a network interface 1107 to allow the computer system 1101A to communicate over a data network 1109 with one or more additional computer systems and/or computing systems, such as 1101B, 1101C, and/or 1101D (note that computer systems 1101B, 1101C and/or 1101D may or may not share the same architecture as computer system 1101A, and may be located in different physical locations, e.g., computer systems 1101A and 1101B may be located in a processing facility, while in communication with one or more computer systems such as 1101C and/or 1101D that are located in one or more data centers, and/or located in varying countries on different continents).

A processor may include a microprocessor, microcontroller, processor module or subsystem, programmable integrated circuit, programmable gate array, or another control or computing device.

The storage media 1106 may be implemented as one or more computer-readable or machine-readable storage media. Note that while in the example embodiment of FIG. 11 storage media 1106 is depicted as within computer system 1101A, in some embodiments, storage media 1106 may be distributed within and/or across multiple internal and/or external enclosures of computing system 1101A and/or additional computing systems. Storage media 1106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 1100 contains one or more method execution module(s) 1108. In the example of computing system 1100, computer system 1101A includes the method execution module 1108. In some embodiments, a single method execution module may be used to perform some aspects of one or more embodiments of the methods disclosed herein. In other embodiments, a plurality of method execution modules may be used to perform some aspects of methods herein.

It should be appreciated that computing system 1100 is merely one example of a computing system, and that computing system 1100 may have more or fewer components than shown, may combine additional components not depicted in the example embodiment of FIG. 11, and/or computing system 1100 may have a different configuration or arrangement of the components depicted in FIG. 11. The various components shown in FIG. 11 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 1100, FIG. 11), and/or through manual control by a user who may make determinations regarding whether a given step, action, template, model, or set of curves has become sufficiently accurate for the evaluation of the subsurface three-dimensional geologic formation under consideration.

The foregoing description, for purposes of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosed embodiments and various embodiments with various modifications as are suited to the particular use contemplated.

What is claimed is:

1. A method for performing autonomous directional drilling, the method comprising:

receiving input data, wherein the input data comprises:

a planned trajectory of a wellbore including a target;

a current position of a bottom of the wellbore;

a plurality of drilling parameters; and a maximum dog leg severity (DLS) capability of a bottom hole assembly (BHA) drilling the wellbore;

determining an amount of DLS to reach the target from the current position of the bottom of the wellbore based upon the input data;

determining a modification to one or more of the drilling parameters based upon the amount of DLS to reach the target and the maximum DLS capability, wherein the modification is also based upon historical offset data from nearby wellbores having similar profiles, wherein the historical offset data comprises a comparison of maximum DLS capabilities of BHAs drilling the nearby wellbores with drilling parameters of the BHAs drilling the nearby wellbores, and wherein the maximum DLS capabilities of the BHAs drilling the nearby wellbores are defined by (1) a rate of penetration (ROP) of the BHAs drilling the nearby wellbores and (2) two numerical coefficients; and performing directional drilling with the BHA while implementing the modification.

2. The method of claim 1, wherein the drilling parameters comprise a steering ratio of the BHA, a rate of penetration (ROP) of the BHA in the wellbore, an inclination of the wellbore, an azimuth of the wellbore, a tool face of the BHA, surface rotations per minute (SRPM), collar rotations per minute (CRPM), a flow rate through the BHA, surface weight-on-bit (WOB), a measured depth (MD) offset to run start, a true vertical depth (TVD) of the wellbore, a mud weight in the wellbore, or a combination thereof.

3. The method of claim 2, wherein the amount of DLS is determined using a single curvature to reach the target based upon the TVD of the wellbore, a North South (NS) of the wellbore, and an East West (EW) location of the wellbore.

4. The method of claim 2, wherein the amount of DLS is determined using a curvature to reach the target defined by the TVD, the inclination of the target, and the azimuth of the target.

5. The method of claim 2, wherein the amount of DLS is determined using a curvature to reach the target defined by a MD of the target, the inclination of the target, and the azimuth of the target.

6. The method of claim 1, wherein the amount of DLS is determined using a plurality of curvatures with varying DLS to reach the target.

7. The method of claim 1, wherein the amount of DLS is determined using a modified Lubinski curvature to reach the target.

8. The method of claim 1, further comprising determining a difference between the amount of DLS to reach the target and the maximum DLS capability, wherein the modification is also determined based upon the difference.

9. The method of claim 1, further comprising displaying an updated trajectory of the wellbore in response to the modification.

10. The method of claim 1, wherein the comparison is defined by Max DLS=a−b*ROP for a ROP range, where Max DLS represents the maximum DLS capabilities of BHAs drilling the similar nearby wellbores, and a and b represent numerical coefficients.

11. A computing system, comprising:

one or more processors; and a memory system comprising one or more non-transitory computer-readable media storing instructions that, when executed by at least one of the one or more processors, cause the computing system to perform operations, the operations comprising:

receiving input data, wherein the input data comprises:

a planned trajectory of a wellbore including a target;

a current position of a bottom of the wellbore;

a plurality of drilling parameters; and a maximum dog leg severity (DLS) capability of a bottom hole assembly (BHA) drilling the wellbore;

determining an amount of DLS to reach the target from the current position of the bottom of the wellbore based upon the input data;

determining a modification to one or more of the drilling parameters based upon the amount of DLS to reach the target and the maximum DLS capability, wherein the modification is also based upon historical offset data from nearby wellbores having similar profiles, wherein the historical offset data comprises a comparison of maximum DLS capabilities of BHAs drilling the nearby wellbores with drilling parameters of the BHAs drilling the nearby wellbores, and wherein the maximum DLS capabilities of the BHAs drilling the nearby wellbores are defined by a flow rate into the nearby wellbores, the flow rate squared, and three numerical coefficients; and causing the modification to be implemented while directional drilling is being performed with the BHA.

12. The computing system of claim 11, wherein the comparison is defined by Max DLS=x+y*Q+z*$Q^2$, where Max DLS represents the maximum DLS capabilities of BHAs drilling the similar nearby wellbores, x, y, and z represent numerical coefficients, and Q represents flow rate.

13. A non-transitory computer-readable medium storing instructions that, when executed by one or more processors of a computing system, cause the computing system to perform operations, the operations comprising:

receiving input data, wherein the input data comprises:

a planned trajectory of a wellbore including a target;

a current position of a bottom of the wellbore;

a plurality of drilling parameters; and a maximum dog leg severity (DLS) capability of a bottom hole assembly (BHA) drilling the wellbore;

determining an amount of DLS to reach the target from the current position of the bottom of the wellbore based upon the input data;

determining a modification to one or more of the drilling parameters based upon the amount of DLS to reach the target and the maximum DLS capability, wherein the modification is also based upon historical offset data from nearby wellbores having similar profiles, wherein the historical offset data comprises a comparison of maximum DLS capabilities of BHAs drilling the nearby wellbores with drilling parameters of the BHAs drilling the nearby wellbores, and wherein the maximum DLS capabilities of the BHAs drilling the nearby wellbores are defined by a number of rotations per minute (RPM) of the BHAs drilling the nearby wellbores and three numerical coefficients, and causing the modification to be implemented while directional drilling is being performed with the BHA.

14. The non-transitory computer-readable medium of claim 13, wherein the comparison is defined by Max DLS=x'+y'*RPM+z'*$RPM^2$, where Max DLS represents the maximum DLS capabilities of BHAs drilling the similar nearby wellbores, and x, y, and z represent numerical coefficients.

15. The non-transitory computer-readable medium of claim 13, wherein the modification is determined by a machine learning (ML) model, an artificial intelligence (AI) model, or a generative AI (GenAI) model based upon a dependency between the maximum DLS capability and the drilling parameters.

16. The non-transitory computer-readable medium of claim 13, wherein the modification comprises a percentage of change to make to the one or more drilling parameters based on a difference between the amount of DLS to reach the target and the maximum DLS capability.

17. The non-transitory computer-readable medium of claim 13, wherein the operations further comprise generating or transmitting a signal that recommends, instructs, or causes the one or more drilling parameters to be physically modified.

18. The non-transitory computer-readable medium of claim 13, wherein the modification comprises a percentage of change to make to two or more of the drilling parameters simultaneously based upon a difference between the amount of DLS to reach the target and the maximum DLS capability.

* * * * *